US010868396B1

(12) United States Patent
Daily et al.

(10) Patent No.: US 10,868,396 B1
(45) Date of Patent: Dec. 15, 2020

(54) SMALL PITCH HIGH-SPEED CONNECTORS

(71) Applicant: TE Connectivity Corporation, Berwyn, PA (US)

(72) Inventors: Christopher George Daily, Harrisburg, PA (US); Matthew Edward Mostoller, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/454,008

(22) Filed: Jun. 26, 2019

(51) Int. Cl.

| | |
|---|---|
| ***H01R 24/84*** | (2011.01) |
| ***H01R 13/28*** | (2006.01) |
| ***H01R 43/26*** | (2006.01) |
| ***H01R 13/50*** | (2006.01) |
| ***H01R 13/6581*** | (2011.01) |
| *H01R 107/00* | (2006.01) |

(52) U.S. Cl.
CPC ..... *H01R 24/84* (2013.01); *H01R 13/28* (2013.01); *H01R 13/50* (2013.01); *H01R 13/6581* (2013.01); *H01R 43/26* (2013.01); *H01R 2107/00* (2013.01)

(58) Field of Classification Search
CPC .... H01R 12/714; H01R 13/514; H01R 13/28; H01R 13/6474; H01R 12/7082; H01R 24/84; H01R 23/27
See application file for complete search history.

(56) References Cited

U.S. PATENT DOCUMENTS

| | | | | |
|---|---|---|---|---|
| 5,098,311 A * | 3/1992 | Roath | H01R 12/714 | 439/290 |
| 5,167,528 A * | 12/1992 | Nishiyama | H01R 23/27 | 29/883 |
| 5,181,855 A * | 1/1993 | Mosquera | H01R 13/28 | 439/74 |
| 6,540,529 B1 * | 4/2003 | Yu | H01R 24/84 | 439/74 |
| 7,762,846 B1 * | 7/2010 | Whiteman, Jr. | H01R 13/514 | 439/607.23 |
| 7,785,152 B2 * | 8/2010 | Yi | H01R 12/7082 | 439/660 |
| 7,892,037 B2 * | 2/2011 | Kodera | H01R 13/6474 | 439/660 |
| 7,976,326 B2 * | 7/2011 | Stoner | H01R 13/28 | 439/295 |

* cited by examiner

*Primary Examiner* — Jean F Duverne

(57) ABSTRACT

High-speed connectors are identically configured each comprising a housing with a first interconnection feature at one location of the housing and a second interconnection feature at another location of the housing with a channel interposed between the first and second interconnection features. The first interconnection feature of the connector is configured to attach with the second interconnection feature of an identical connector and vise versa. The housing channel includes opposed wall sections with shields attached thereto that connect with one another when the connectors are combined. A plurality of electrical terminals is disposed within each housing channel and extend a length from a channel floor to a channel opening. The electrical terminals form an electrical/mechanical contact between interconnecting electrical terminal pairs when the connectors are joined together. In an example, two or more points of electrical/mechanical contact are formed between interconnecting electrical terminal pairs.

20 Claims, 7 Drawing Sheets

SMALL PITCH HIGH-SPEED CONNECTORS

FIELD

Small pitch high-speed connectors as disclosed herein are used in high-speed data transfer applications and are configured for electrical connection with a printed circuit board and, more specifically, small-pitch high-speed connectors as disclosed are specially engineered having a hermaphroditic design with electrical terminals having redundant points of contact between one another so as to provide a highly reliable and robust electrical connection in high-speed data transfer applications in a manner that is resistant to vibration.

BACKGROUND

The use of connectors in applications calling for high-speed data transmission is known in the art, wherein such connectors are conventionally connected to a board such as a printed circuit board along one surface and are configured along another surface to accommodate an electrical connection with an external connector. In such conventional high speed connectors, the connection with the external connector is made via a pin-in-socket configuration, e.g., wherein the connector comprises one or more sockets or the like that are configured to receive a respective pin from the external connector therein, or vise versa where the connector comprises one or more pins that are configured to fit within one or more respective sockets of the external connector.

While such conventional connectors are cable of providing a high-speed data interconnection transmission platform between a board and an external connector, this requires the use of two distinct and separate parts, namely the board connector and the external connector, whereby, the separate parts must be made, acquired, and inventoried independently for use. As a result of such parts being configured differently, there is the possibility that the electrical connection made between the board connector and the external connector, e.g., through the respective electrical terminals, may not be optimally configured and/or aligned to provide a desired consistent contact profile/surface area between the terminals. In such high-speed data transmission applications, the presence of inconsistent contact profiles/surface areas between the plurality of electrical terminals that are interconnected introduces noise into the system that can interfere with the desired data transmission and downstream system operations. Additionally, the presence of such inconstant contact profile/surface area between the interconnecting electrical terminals may cause such interconnection to be vulnerable to vibration environments, where the presence of vibration may operate to loosen the electrical interconnection between the electrical terminals. Such vibration environments may also introduce unwanted noise into the system and/or may ultimately cause a disconnect between the electrical terminals and termination of the data transmission.

It is, therefore, desired that high-speed connectors be constructed in a manner that enables providing high-speed data transmission between connectors without the need for differently configured board connectors and external connectors. It is further desired that the high-speed connectors be configured such that the electrical terminals being interconnected for high-speed data transmission are identically configured so as to ensure that the contact profile/surface area between interconnected electrical terminals are identical. Thereby, operating to provide an improved degree of electrical performance when compared to conventional connectors. Still further, it is desired that the electrical terminals be configured in a manner that provides a robust interconnection with one another to ensure a secure electrical connection therebetween, thereby providing an improved degree of vibration resistance and increased effective service life when compared to conventional high-speed connectors.

SUMMARY

High-speed connectors as disclosed herein have a hermaphroditic design to interconnect with an identical connector. Such connector comprises a housing formed from a dielectric material having a first interconnection feature at one location of the housing and a second interconnection feature at another location of the housing. In an example, the first and second interconnection features of the connector are configured to complement and engage with respective second and first interconnection features of an identical connector. In an example, the connector housing has a generally rectangular configuration, and the first and second interconnection features are located adjacent opposed longitudinal ends of the housing. In an example, the first interconnection feature is positioned at one end of the housing within a portion of a recessed channel, wherein the second interconnection feature is positioned at end of the housing opposite the first interconnection feature. The second interconnection feature is positioned outside of the recessed channel. The first interconnection feature includes a member extending outwardly from a floor of the recessed channel, and the second interconnection feature includes a cavity.

In an example, the connector housing includes opposed wall sections that define the recessed channel therein having depth defined between the channel floor and a channel opening. In an example, the connector housing includes a first section and a second section, wherein the first section is defined by a first pair of opposed walls and the second section is defined by a second pair of opposed walls that are separate from the first pair of opposed walls. In an example, the first pair of opposed walls are positioned a greater distance apart from one another than the second pair of opposed walls so that the housing second section of the identical connector fits within a housing first section of the identical connector. A first pair of shields are disposed along an inside surface of the first pair of opposed walls, and a second pair of shields are disposed along an outside surface of the second pair of opposed walls. The first and second pair of shields of the connector are connected with respective second and first pair of shields of the identical connector.

The connector comprises a plurality of electrical terminals disposed within the channel and extending a length from the floor towards the channel opening. In an example, the plurality of electrical terminals is interposed within the channel between the housing first and second interconnection features. In an example, the electrical terminals are oriented within the channel in one or more rows, and wherein the floor adjacent each electrical terminal includes a raised section that extends outwardly a distance from the floor along a partial section of the electrical terminal to thereby isolate such partial section from a partial section of an adjacent electrical terminal in the same row.

In an example, each electrical terminal includes a contact section disposed in the channel that is configured to provide a point of contact between two interconnected electrical terminals when the connector is combined with the identical connector. In an example, the electrical terminals are configured to provide two or more points of contact between two interconnected electrical terminals. In an example, each electrical terminal contact section comprises a planar section extending from the floor into the channel and an angled section extending from the planar section and forming an end of the electrical terminal. The angled sections of opposed electrical terminals are in connect with the planar sections of each other opposed electrical terminal to provide two points of mechanical and electrical contact between opposed interconnected electrical terminals. In an example, each electrical terminal contact section comprises a planar section adjacent the floor that extends axially and form a pair of angled sections extending therefrom. The angled sections of two combined opposed electrical terminals from two connectors are each in contact with planar sections of the respective opposed electrical terminal to thereby provide four points of contact between opposed interconnected electrical contacts.

BRIEF DESCRIPTION OF THE DRAWINGS

Small pitch high-speed connectors as disclosed herein will now be described by way of example with reference to the accompanying figures, of which.

DETAILED DESCRIPTION

Figure 1:
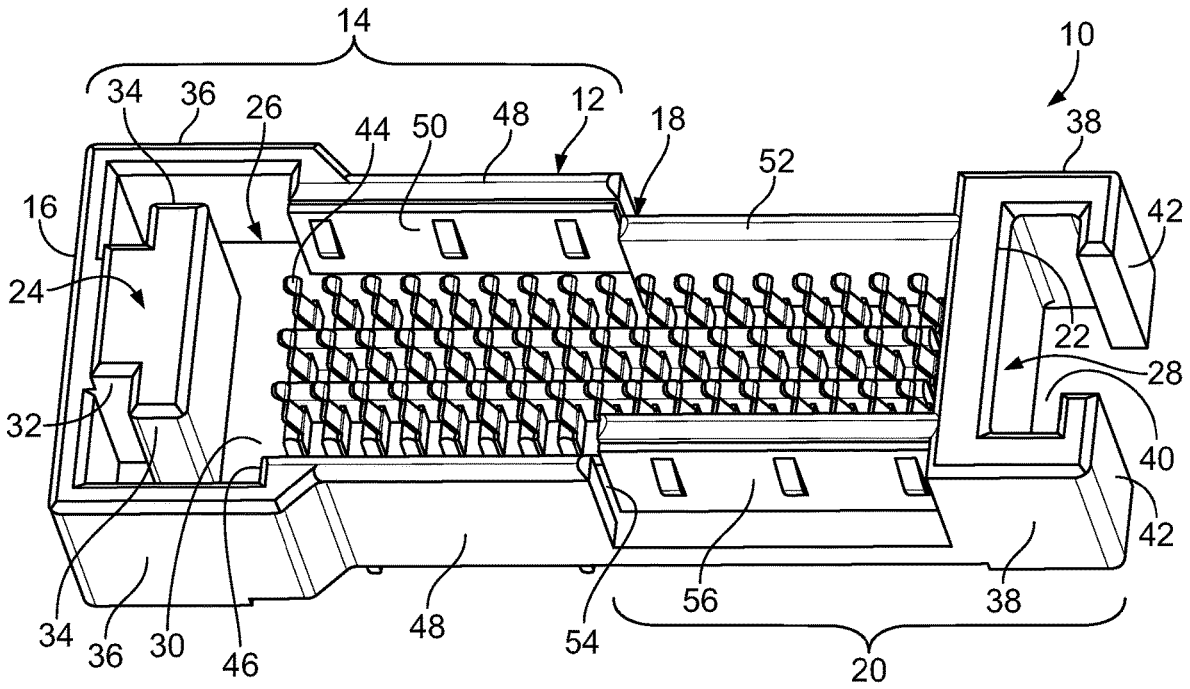
FIG. 1 is a perspective top side view of an example connector as disclosed herein.

Embodiments of high-speed connectors as disclosed herein will be described hereinafter in detail with reference to the attached drawings, wherein like reference numerals refer to the like elements. High-speed connectors as disclosed herein may, however, be embodied in many different forms and should not be construed as being limited to the embodiments set forth herein; rather, these embodiments are provided so that the disclosure will be thorough and complete, and will fully convey the concept of high-speed connectors to those skilled in the art.

High-speed connectors as disclosed herein are generally configured in the form of a single hermaphroditic part that when duplicated is capable of mating with itself to provide interconnection between electrical terminals to facilitate high-speed data transmission between the connectors. In an example, the connector comprises a housing having first and second sections that are configured to mate and fit together with respective second and first sections of a duplicate connector. The housing includes a plurality of electrical terminals that are specially configured to interconnect with identical electrical terminals of a duplicate connector to provide a consistent contact profile/surface area, and optionally the electrical terminals are engineered to provide more than one point of contact between interconnecting electrical terminals, thereby adding an improved degree of contact robustness for use in vibration environments. The ability to provide a high-speed electrical interconnection between duplicate identical connectors reduces manufacturing costs and makes it easier on the end user by avoiding having to track and use a connecting member having a second part number.

Figure 2:
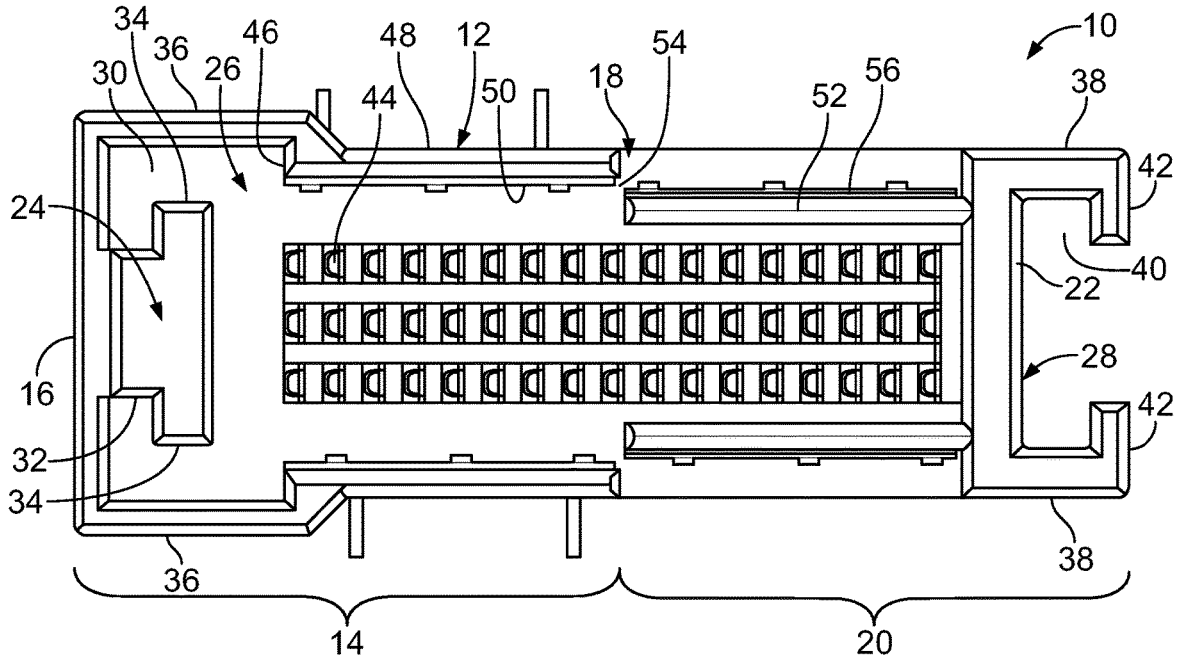
FIG. 2 is a top view of the example connector of FIG. 1

FIGS. 1 and 2 illustrate an example high-speed connector 10 as disclosed herein comprising a housing 12 formed from a structurally rigid material and configured to facilitate interconnection with a duplicate connector. In an example, the housing is formed from an electrically nonconductive material such as plastics, liquid crystal polymer materials, or the like. In an example, the connector housing may be formed by conventional connector forming techniques such as by molding and/or machining or the like. In an example, the connector housing 12 is formed by molding technique. In an example, the housing 12 is configured having a first section 14 that extends from a first end 16 inwardly to a middle section 18, and a second section 20 that extends from a second end 22 opposite the first end 16 to the middle section 18. In an example, the body has a generally rectangular shape, wherein the first and second sections 14 & 20 extend longitudinally within the body between the opposed ends 16 and 22. However, it is to be understood that connectors as disclosed herein may be shaped differently depending on the particular end-use application and that all such shapes are intended to be within the scope of connectors as disclosed herein.

A first interconnection feature 24 is disposed in the housing first section 14 adjacent the first end 16 and extends within a recessed channel 26. The first interconnection feature 24 is configured to complement and fit together with a second interconnection feature 28 of a duplicate connector that is disposed adjacent the second end 22. In an example, the first interconnection feature 24 is in the form of a T-shaped element that projects upwardly from a floor 30 of the channel and that comprises a stem portion 32 extending outwardly from the first end 16 a distance to opposed outward facing portions 34. In an example, the first interconnection feature 24 extends upwardly a distance from the floor 30 that is slightly more than a first pair of opposed side walls 36.

A portion of the recessed channel 26 in the housing first section 14 surrounding the first interconnection feature 24 is open and configured to accommodate placement of the second interconnection feature 28 of a duplicate connector therein. In an example, the second interconnection feature 28 extends outwardly from the second end 22 and includes opposed side walls 38 that form an open cavity 40, wherein the opposed walls 38 include end sections 42 that project inwardly towards each other a partial distance. Configured in this manner, the second interconnection feature 28 open cavity 40 is configured to accommodate the first interconnection feature outward facing portions 34 therein, and the second interconnection feature end sections 42 are configured to accommodate placement of the first interconnection feature stem portion 32 therebetween.

While example connector first and second interconnection features have been disclosed and illustrated comprising certain complementing surface configurations, it is to be understood that the first and second interconnecting features may be configured differently while functioning to provide a desired interconnecting mechanical fitment between duplicate connectors, and doing so at a location that is remote from electrical terminals 44 that are disposed within the channel 26, thereby avoiding the possibility of damaging the electrical terminals during the step of combining the duplicate connectors together. Thus, all such alternative housing first and second interconnection feature configurations are intended to be within the scope of connectors as disclosed herein.

In an example, a plurality of electrical terminals 44 are disposed within the housing first and second sections 14 and 20 within the channel 26. In an example, the electrical terminals 44 may be arranged in one or more rows that extend longitudinally within the channel, and in one or more columns extending between the one or more rows. It is understood that the number and placement of electrical terminals within the channel can and will vary depending on the particular end-use application, and all such variations are within the scope of the connector as disclosed herein. The example connector illustrated comprises a grid array of electrical terminals arranged comprising three rows and seventeen columns for a total of fifty-one electrical terminals. In an example, the electrical terminals in each row are placed approximately the same distance from adjacent electrical terminals in the same row, and the electrical terminals in each column are placed the approximate same distance from adjacent electrical terminals in the same column. Such precise placement of the electrical terminals is useful to ensure desired interconnecting engagement and contact when duplicate connectors are connected with one another.

The housing first section 14 first pair of opposed side walls 36 surrounding the first interconnection feature extends from the housing first end 16 a distance to an inwardly directed shoulder section 46. The first pair of side walls 36 are positioned a sufficient distance apart from one another to accommodate placement of a duplicate connector second interconnection feature opposed walls 38 therein. In an example, the shoulder section 46 is positioned a sufficient distance from the first end 16 to longitudinally trap the second interconnection feature therebetween. In an example, the shoulder section 46 is positioned such that the second interconnection feature, while interconnecting with the first interconnection feature, does not come into contact with the electrical terminals 44 located along an outer column in the channel adjacent the first end 16.

The housing first section 14 includes a second pair of opposed side walls 48 extending longitudinally from each respective shoulder section 46, and that are positioned a reduced distance apart from one another relative to the first pair of side walls 36. In an example, a first pair of shields 50 in the form of plate elements are disposed along inside surfaces of the second pair of side walls 48. The first pair of shields 50 are formed from an electrically conductive material. In an example, the second pair of side walls 48 extend to the middle section 18 of the housing. A third pair of opposed side walls 52 extend longitudinally from the middle section 18 to the housing second end 22. In an example, the third pair of side walls 52 are independent and not connected with the second pair of side walls 48, as evidenced by an air gap 54 disposed therebetween, and the distance between the third pair of side walls 52 is less than that of the second pair of side walls 48. A second pair of shields 56 in the form of plate elements is disposed along an outside surface of the third pair of opposed side walls 52. In an example, the second pair of side walls 48 are positioned apart a distance that enables the third pair of side walls 52 from a duplicate connector to be disposed therebetween so that the first and second pair of shields 50 and 56 mechanically and electrically engage and connect with one another when the connectors are engaged and mated together.

Figure 3:
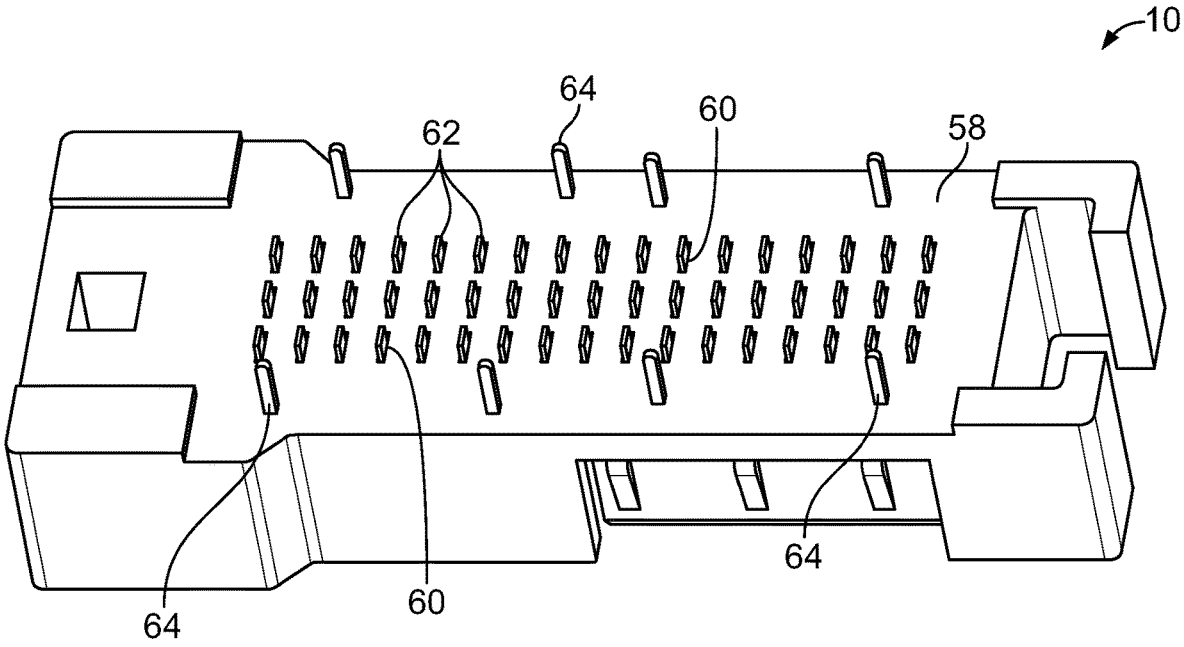
FIG. 3 is a perspective bottom side view of the example connector of FIG. 1.
Figure 4:
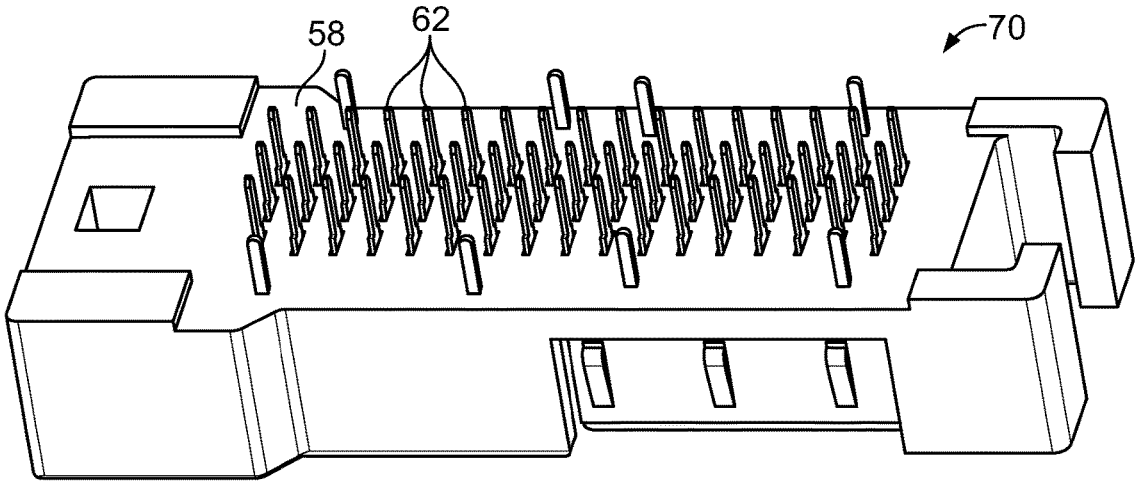
FIG. 4 is a perspective bottom side view of another example connector as disclosed herein.

FIG. 3 illustrates the example connector 10 comprising a housing underside surface 58. In an example, the channel floor is configured comprising a plurality of openings 60 for accommodating placement of electrical terminal base portions 62 extending therethrough. The electrical terminal base portions 62 may be configured as useful for providing a board termination with the connector, e.g., an electrical connection with a printed circuit board or the like, using conventional board attachment techniques. In an example, the electrical terminal base portions 62 may be configured as surface mount terminals for electrical connection by conventional technique such as solder attachment, press-fit attachment, or the like. In an example, the first and second set of the shields comprise pins 64 that extends through the channel floor to the underside surface for electrical attachment by conventional technique. FIG. 4 illustrates an alternative embodiment of the example connector 70 comprising an underside surface 58, whereby the electrical terminal base portions 62 that project from the underside surface are provided in the form of pins for providing a board termination through a solder tail (wave or pin in paste) connection or the like instead of a surface mount terminal as illustrated in FIG. 3.

Figure 5:
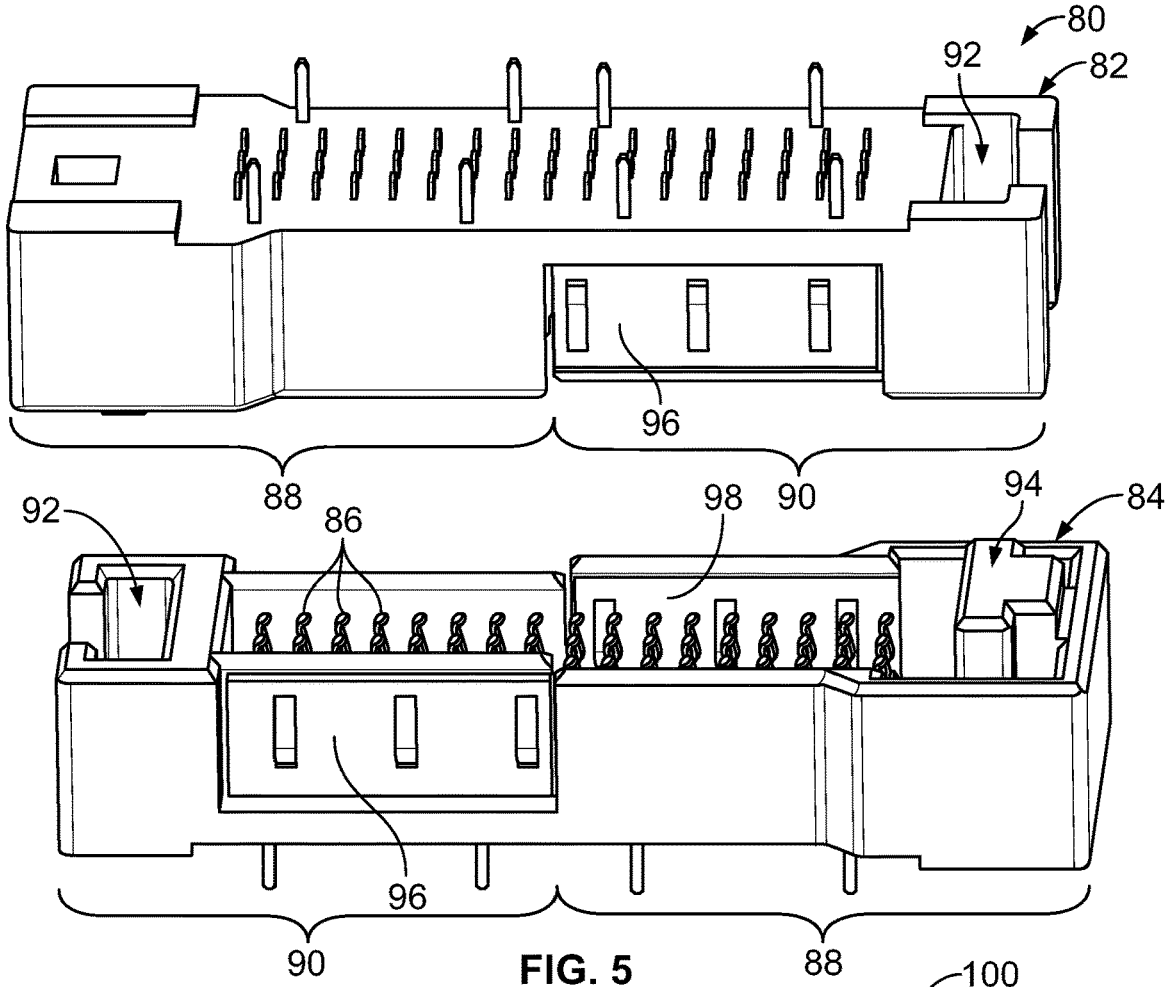
FIG. 5 is a perspective side view of two example connectors of FIG. 1 inverted relative to one another and in a state ready for connection with each other.

FIG. 5 illustrates a connector assembly 80 comprising a pair of identical high-speed connectors 82 and 84 as disclosed herein. In this example, a first connector 82 is positioned above a second connector 84, wherein the first and second connectors are oriented with the respective electrical terminals 86 opposed to one another, and such that the first connector 82 housing first section 88 and second section 90 are aligned to connect with the second connector 84 respective second section 90 and first section 88. In this configuration, when the first and second connectors are joined together, the first connector 82 first interconnection feature (not shown) will engage the second connector second connection feature 92, and the second connector first interconnection feature 94 will engage the first connector second connection feature 92. Also illustrated is the orientation of the first and second connector respective first and second pair of shields, wherein the first connector 82 first pair of shields (not shown) are oriented to fit over the second connector second pair of shields 96, and the second connector first pair of shields 98 are oriented fit over the first connector second pair of shields 96. Configured in this manner, the identical connectors facilitate interconnection of the housing first and second interconnection features, the first and second shields, and the electrical terminals by combining the two connectors together.

Figure 6:
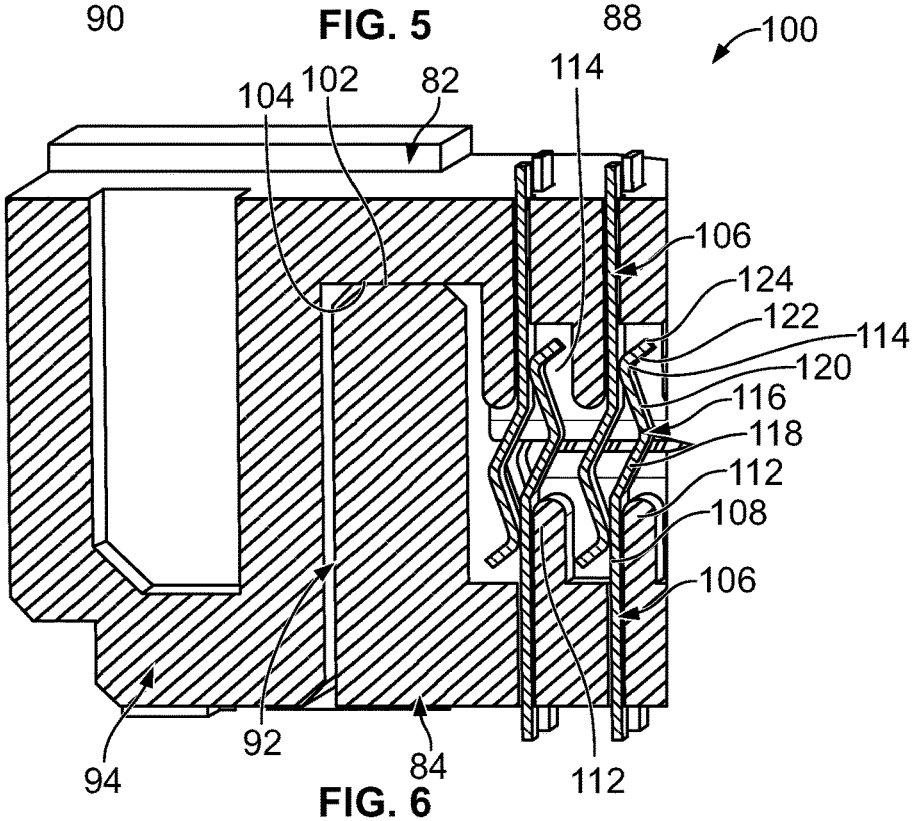
FIG. 6 is a perspective sectional side view of interconnecting electrical terminals between two example connectors of FIG. 1 in an attached state.

FIG. 6 illustrates a side section of a connector assembly 100 as disclosed herein comprising the pair of identical connectors 82 and 84 configured in the manner described above and placed into a full state of attachment with one another. In such fully attached position, the first connector 82 first interconnection feature 94 is shown fully accommodated within the second connector 84 second interconnection feature 92 such that a top surface 102 of the second interconnection feature 92 abuts against the channel floor 104 of the first connector 82. Also illustrated is the configuration of the electrical terminals 106 that are identical for each of the first and second connectors. In an example, each electrical terminal 106 comprises a straight or planar section 108 that extends through an opening in the channel floor. In an example, the channel floor includes a raised section 112 that extends upwardly a partial distance from the floor, and that is positioned against a backside surface of the electrical terminal straight section 108 to stabilize and fix an upright placement of the electrical terminal straight section within the channel. In an example, where there are a number of electrical terminals arranged in a row, there is a plurality of raised sections 112 positioned between each of the electrical terminals, and a recessed space 114 that exists between each raised section. It is to be understood that the raised sections 112 are optional.

In an example, each electrical terminal includes an angled section 116 that extends outwardly away from the straight section 108. In an example, the angled section 116 extends from the straight section 108 adjacent an end of the channel raised section 112. In an example, the angled section 116 includes a first portion 118 and a second portion 120 that together form a V-shaped configuration. In an example, the first portion 118 has a positive angle of departure from about 5 to 45 degrees relative to a plane running along the straight section 108, and the second portion 120 extends from the first portion 118 and has a negative angle of departure from about 5 to 45 degree relative to a plane running along the straight section 108. In an example, the positive angle of departure for the first portion 118 and the negative angle of departure for the second portion 120 are the same, thereby forming the V-shape configuration. In such example, the electrical terminal angled section second portion 120 extends to an end section 122 that is aligned with the plane running along the straight section 108. In an example, the electrical terminal end section 122 includes an angled tip 124 that departs from the end section 122 in a positive angle of departure relative to the plane running along the straight section 108.

The electrical terminals are configured in this manner for purposes of engaging one another and forming a desired mechanical and electrical interconnection therebetween. As the two connectors are joined together, the angled tips 124 of the end sections 122 operate to facilitate engagement with opposed electrical terminals without snagging and, as the two connectors are further brought together, the electrical terminal end sections 122 of respective opposed electrical terminals wipe along a surface of the opposed electrical terminal straight sections 108 opposite the channel raised sections 112 and form an mechanical and electrical connection therewith. The channel raised sections 112 operate to support and maintain the position of the electrical terminal straight sections 108 while the opposed electrical terminal end sections 122 impose a compression contact force thereon. The recessed space 114 between the raised sections 112 is configured to accommodate placement of the respective opposed electrical end sections 122 therein. Configured in this manner, the opposed electrical terminals from the duplicate joined together connectors provide two points of contact with one another, i.e., the end sections of each opposed electrical terminal are in contact with the respective straight sections of the opposed electrical terminals.

Figure 7:
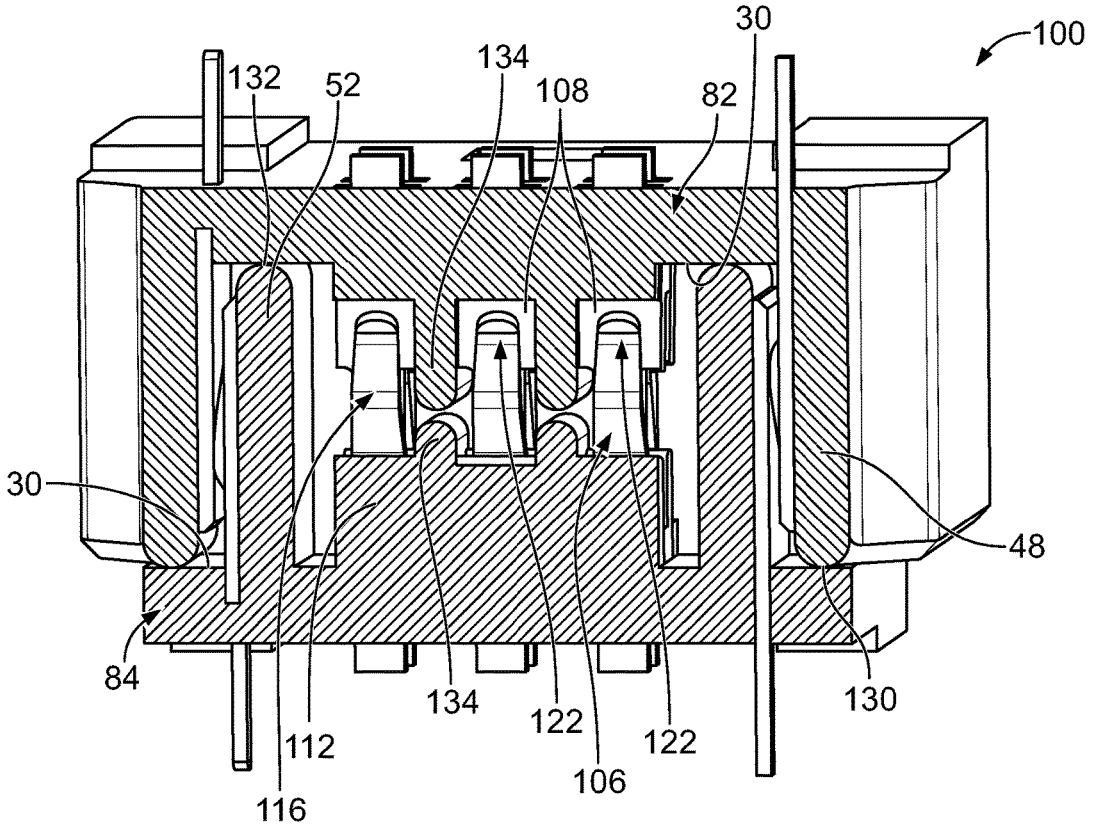
FIG. 7 is a perspective sectional front view of interconnecting electrical terminals between two example connectors of FIG. 1 in an attached state.

FIG. 7 illustrates a front section of the connector assembly 100 as disclosed herein comprising the pair of identical connectors 82 and 84 configured in the manner described above and placed into a full state of attachment with one another. In such fully attached position, the first connector 82 second pair of wall sections 48 are shown fully accommodating the second connector third pair of wall section 52 therein, with ends 130 and 132 of each of the respective wall sections 48 and 52 in contact with opposed connector housing channel floors 30. In such attached configuration, the first and second pair of shields 50 and 56 from the respective first and second connectors 82 and 84 are fully connected with one another.

While FIGS. 6 and 7 illustrate electrical terminals having a specific configuration as described above, it is to be understood that this is but one example configuration of electrical terminals that function to interconnect with one another in a manner providing more than one point of contact therebetween, and that all such other configurations of electrical terminals capable of fulfilling this function are intended to be within the scope of connectors as disclosed herein.

A column of the electrical terminals 106 is shown with raised sections 112 shown extending upwardly from the channel floor, and with dividers 134 disposed between adjacent electrical terminals in the column that operate to isolate the electrical terminals in each column from each other. As illustrated in this view, the second connector 84 electrical terminal end sections 122 are in contact with the first connector electrical terminal straight sections 108. In an example, the electrical terminal straight sections 108 are configured having a greater width than the angled sections 116 and end sections 122 for the purpose of providing a desired contact surface area between opposed interconnecting electrical connectors. In an example, the electrical terminal straight section may have a width along a contact surface that is up to 50 percent greater than that of the electrical terminal end section. Alternatively, the electrical terminals may be configured having the same width along contacting portions. Further, it is desired that the electrical terminal straight section contact area have a desired length, and the end section of an opposed electrical connector be positioned so that during the process of joining the first and second connectors together, the opposed electrical terminals end sections have a desired wiping length along the respective electrical terminal straight section so as to remove any surface debris or the like therefrom before forming the final interconnecting electrical mechanical contact therebetween.

Figure 8:
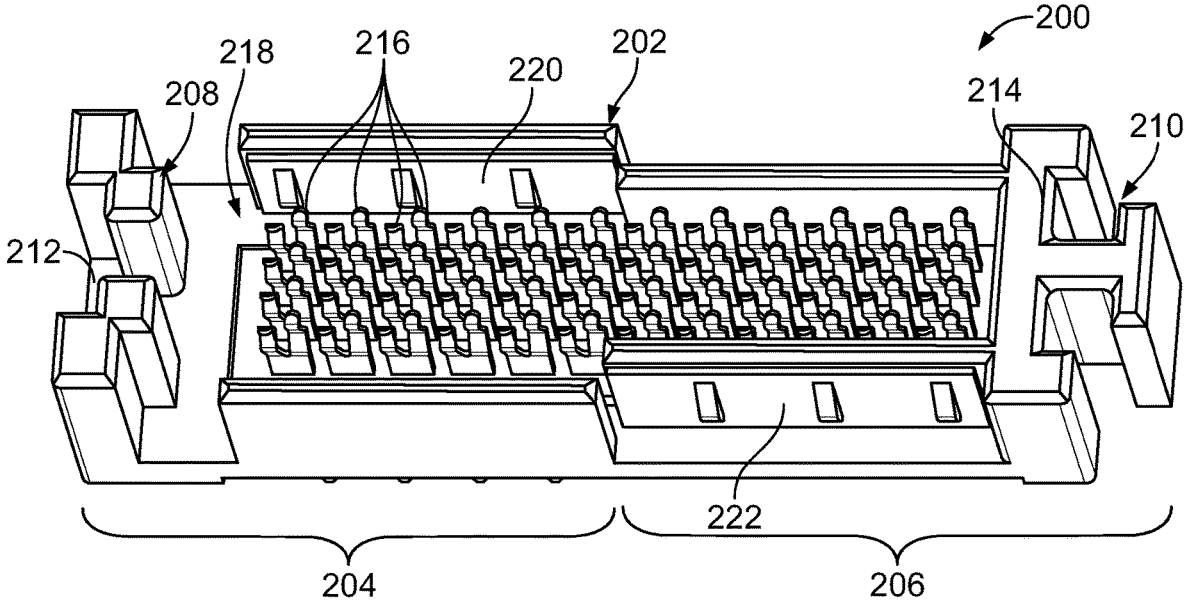
FIG. 8 is a perspective top side view of another example connector as disclosed herein.

FIG. 8 illustrates another example high-speed connector 200 as disclosed herein that is configured somewhat similar to the example connector illustrated in FIGS. 1 and 2, comprising a housing 202 with first and second sections 204 and 206, and first and second interconnection features 208 and 210 disposed adjacent respective ends 212 and 214 of the housing. As with the earlier described example connector, the example connector 200 is configured having a hermaphroditic design to mate with a duplicate of itself. The first and second interconnection features 208 and 210 are configured differently than in the earlier example connector, and yet perform the same feature of facilitating engagement and interconnection between duplicate connectors in a manner that avoids any possible damage to the electrical terminals 216 disposed within the channel 218, i.e., the first and interconnection features are positioned outside of the channel area containing the electrical terminals. The connector 200 also includes the first and second pair of shields 220 and 222 disposed along the respective first and second housing sections 204 and 206. A feature of this example connector 200 is that it does not include a wall structure surrounding the first interconnection feature. Further, this connector is configured comprising electrical terminals 216 that are specially engineered to provide four points of contact between two interconnecting electrical terminal pairs.

Figure 9:
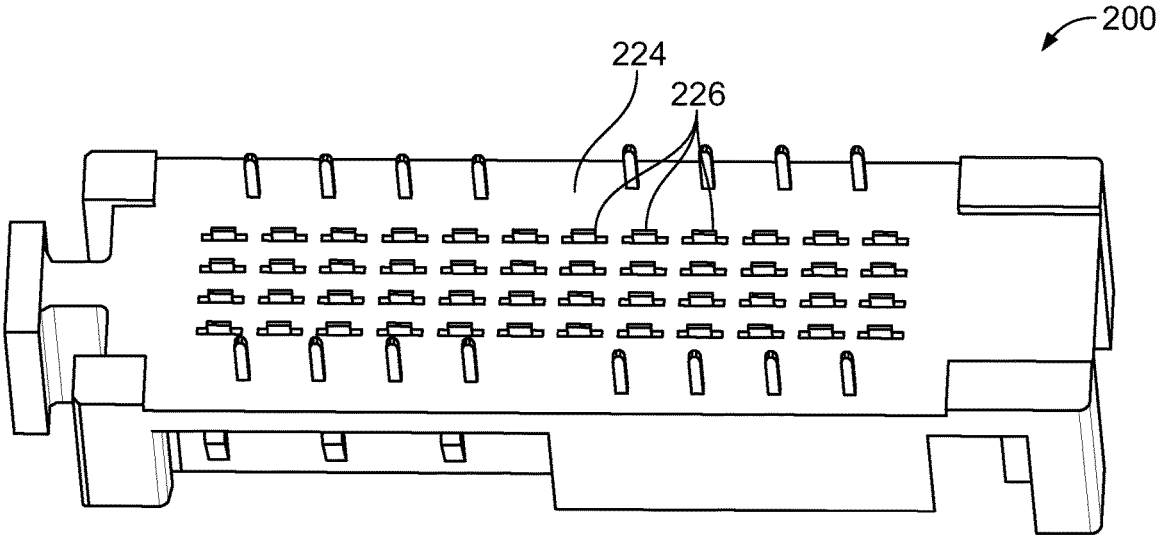
FIG. 9 is a perspective bottom side view of the example connector of FIG. 8.

FIG. 9 illustrates the example high-speed connector 200 of FIG. 8 showing an underside surface 224 of the housing 202. As noted above for the earlier example high-speed connector described, the electrical terminals each include base portions 226 that may be configured to provide board termination, e.g., connection with a printed circuit board or the like, using surface mount terminals as discussed above. Alternatively, the connector may be connected to a board through the use of electrical terminal base portions provided in the form of posts to provide board termination via solder tail attachment. It is to be understood that the example connector 200 may be configured to accommodate board termination using other conventional attachment techniques and that all such techniques are intended to be within the scope as disclosed herein.

Figure 10:
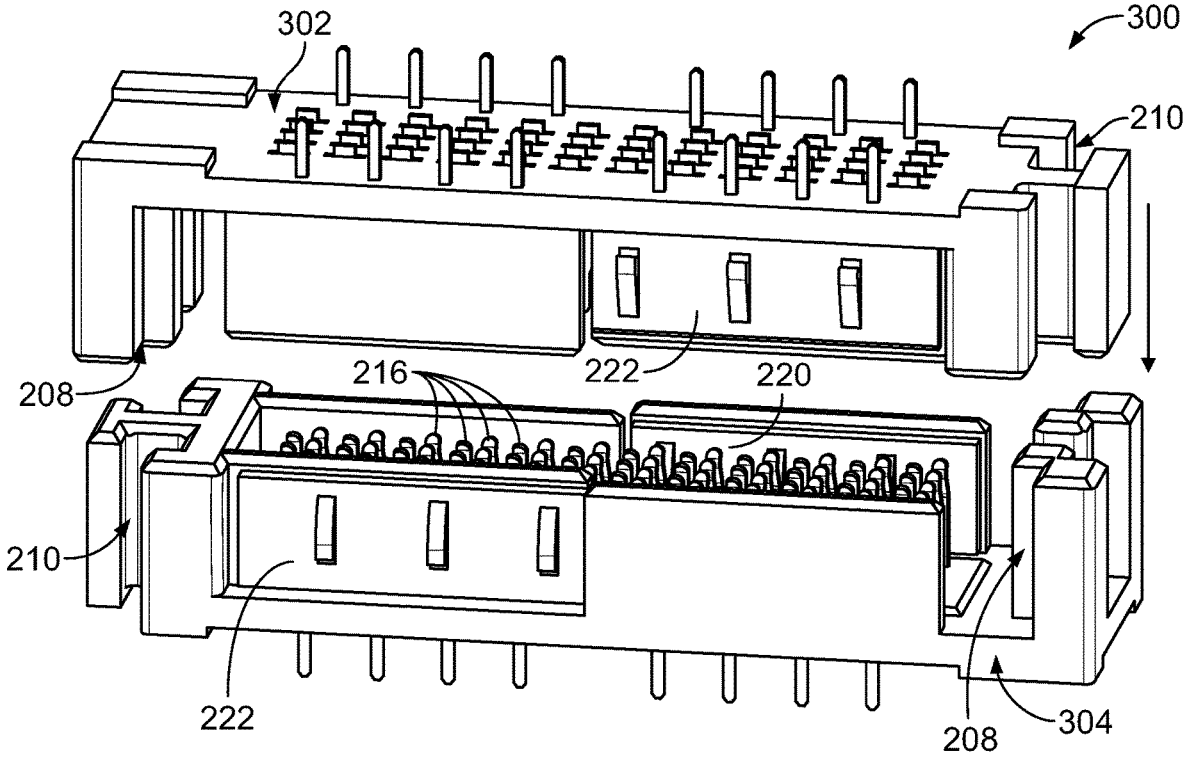
FIG. 10 is a perspective side view of two example connectors of FIG. 9 inverted relative to one another in a state ready for connection with each other.

FIG. 10 illustrates a connector assembly 300 comprising a pair of identically configured high-speed connectors 302 and 304 as disclosed herein and as illustrated in FIG. 8. As noted above for the earlier example connector assembly illustrated in FIG. 5, the connector assembly 300 is provided by positioning inverting each of the connectors 302 and 304 towards one another with the electrical terminals 216 of each connector opposed to one another, and then combining the connectors 302 and 304 together causing the first and second interconnecting features 208 and 210 of the respective connectors to engage and connect with one another. During this step, the first and second pair of shields 220 and 222 of each connector engage and connect with one another.

Figure 11:
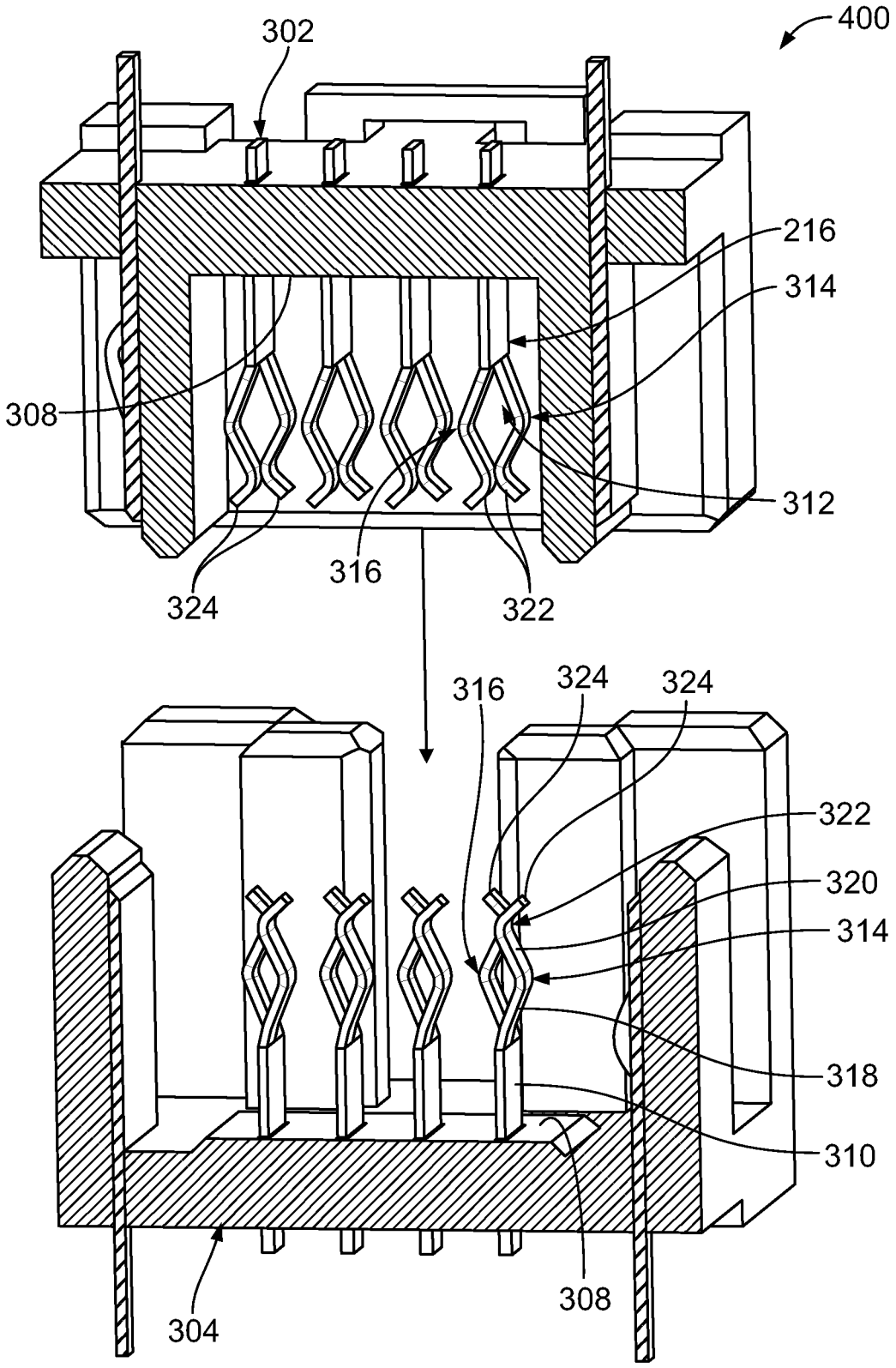
FIG. 11 is a perspective sectional front view of two example connectors of FIG. 9 showing respective opposed electrical terminals in an unconnected state.

FIG. 11 shows a front view of a section of the assembly 400 with the connectors 302 and 304 in position to engage and attach with one another. A feature of the example connectors 302 and 304 is the use of electrical terminals 216 that extend outwardly from each respective connector channel floor 308 and that are configured to provide four points of contact when interconnected with one another. Each electrical terminal 216 comprises a straight or planar section 310 that extends outwardly a distance from the channel floor 308 to a split, bifurcated, or splayed section 312 from which two separate portions 314 and 316 extend outwardly therefrom. In an example, each of the separate portions 314 and 316 have an angled V-shaped configuration, similar to the configuration of the electrical terminal angled section as discussed for the earlier example as best illustrated in FIG. 6.

In this example, each of the separate angled portions 314 and 316 comprise a first segment 318 having a positive angle of departure that extends to a second segment 320 having a negative angle of departure each relative to a plane running along the straight section 310. In an example, the angle of departure for each first and second segment is the same such that an end sections 322 of each is aligned with the plane of the straight section 310. In an example, each of the angled portion first segments 318 of a single electrical terminal depart in opposite directions from one another, and each of the respective the angled section second segments 320 converge towards one another. The separate angled segment end sections 322 each include angled tips 324 that depart in opposed outward directions from one another. The angled tips 324 operate to facilitate engagement with opposed electrical terminals without snagging. A feature illustrated in FIG. 11 is the placement position of the electrical terminals 216 within channel floor 308. In this example, the electrical terminals are positioned having a width dimension as measured between sides edges defining the straight section 310 facing one another in each column running between side wall sections of the channel, while in the earlier discussed example the electrical terminals were positioned with the width dimension facing one another in each row running between the housing first and second ends. It is to be understood that the electrical terminals may be attached differently within the housing as called for by the particular end use application.

Figure 12:
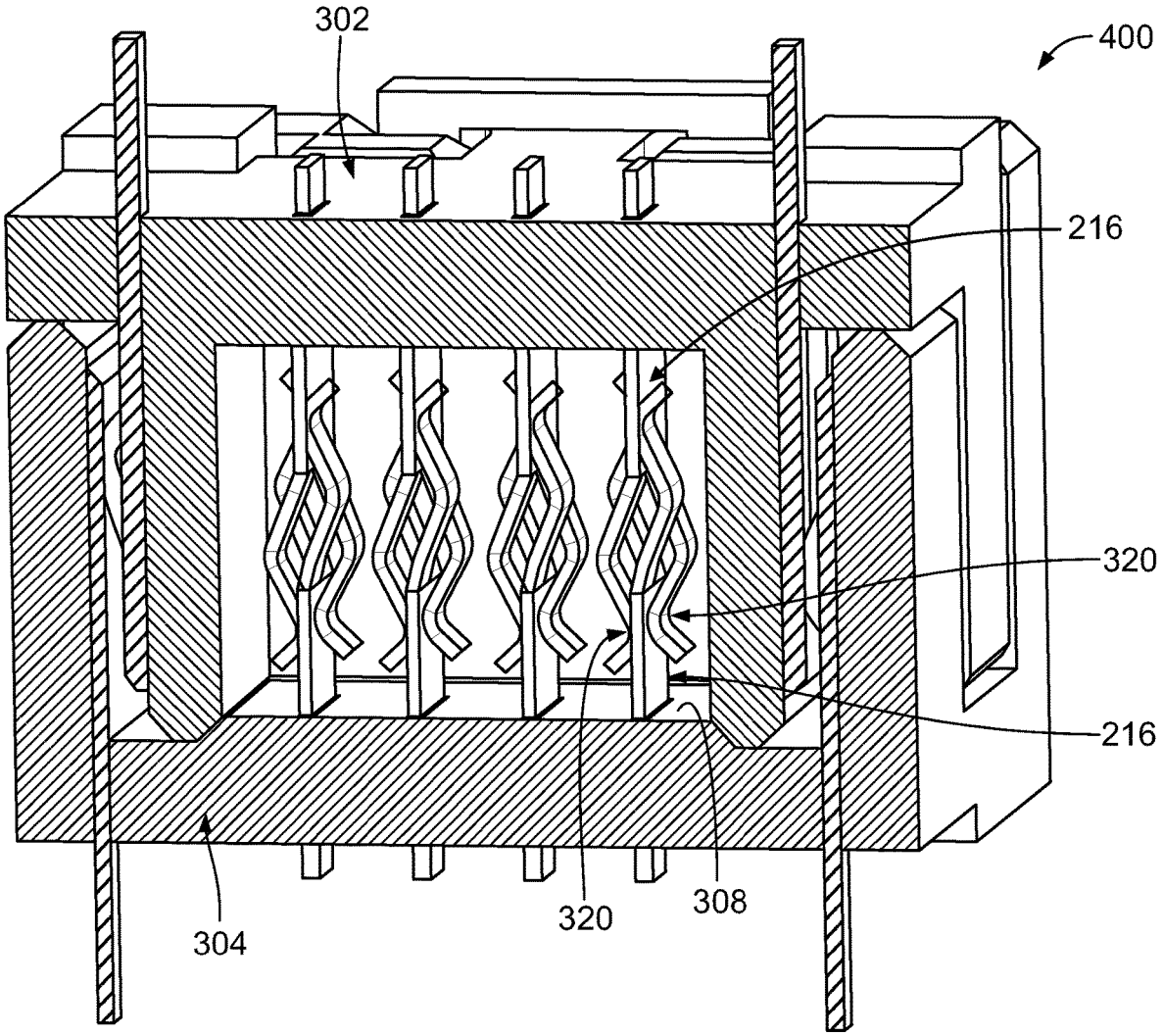
FIG. 12 is a perspective sectional front view of interconnecting electrical terminals between example two connectors of FIG. 9 in an attached state.

FIG. 12 illustrates a front section view of the connector assembly 400 showing the first and second connectors 302 and 304 in an attached state similar to that illustrated in FIG. 6 for the earlier described example connector assembly. In this attached state, the opposed electrical terminals 216 of each connector 302 and 304 are mechanically and electrically interconnected with one another. The two end sections 320 of each of the two electrical terminals are in electrical and mechanical contact with opposed surfaces of the straight sections 310 of each of the two electrical terminals, thereby providing four points of contact between each pair of interconnected electrical terminals 216. In an example, the straight section 310 of each electrical terminal is sized having a desired width dimension to accommodate contact with opposed electrical terminal end sections 320 on opposed sides thereof. Additionally, as noted for the example connector disclosed above and illustrated in FIG. 6, in an example it is desired that the electrical terminal be configured to provide a desired wipe length by the end sections along the straight section, during engagement of the connectors, to ensure a clean mechanical and electrical contact between opposed electrical terminals when the connectors are fully attached.

A feature of high-speed connectors as disclosed herein is the hermaphroditic design enabling for electrical connection to be made by using two identical connectors, thereby eliminating the need to make, purchase and keep in inventory more than one part for purposes of making a desired board-to-board electrical connection. Another benefit of such hermaphroditic design is constancy with respect to the configuration of the electrically connecting components such as the electrical terminals for purposes of ensuring a desired consistency and continuity of electrical interconnection, helping to reduce or eliminate unwanted noise that may result from inconstant electrical connections and providing balanced electrical performance. A further feature of connectors as disclosed herein is the feature of the electrical terminals being configured to provide more than one point of electrical and mechanical contact between paired interconnecting electrical terminals. Having two or more points of contact between pairs of interconnecting electrical terminals provides a robust electrical and mechanical connection enabling high-speed connectors as disclosed herein to be used in high vibration applications not possible before with conventional connectors The foregoing description and accompanying figures illustrate the principles, preferred embodiments and modes of operation of the high-speed connectors as disclosed herein. However, such high-speed connectors should not be construed as being limited to the particular embodiments discussed above. For example, while embodiments of high-speed connectors having a hermaphroditic design have been illustrated comprising electrical terminals capable of providing two or more points of contact between interconnecting electrical terminals, it is to be understood that high-speed connectors having a hermaphroditic design may be configured with electrical terminals providing a single point of contact between interconnecting electrical terminals. In such an alternative example, each connector housing is configured comprising electrical terminals of two different configurations, wherein electrical terminals of one configuration are disposed on one side of a horizontal centerline or vertical centerline running through the housing, and electrical terminals of another configuration are disposed on the other side of the horizontal or vertical housing centerline. Configured in this manner, when two duplicate connector housings are inverted and positioned for attachment with one another, the interconnecting electrical terminal pairs will comprise one of each such differently configured electrical terminals, which are configured to provide a single point of electrical and mechanical contact therebetween.

Additional variations of the embodiments discussed above will be appreciated by those skilled in the art. Therefore, the above-described embodiments should be regarded as illustrative rather than restrictive. Accordingly, it should be appreciated that variations to those embodiments can be made by those skilled in the art without departing from the scope of the high-speed connectors as defined by the following claims.

What is claimed is:

1. A connector configured to mate with an identical connector, the connector having a hermaphroditic design comprising:

a housing formed from a dielectric material and comprising a first interconnection feature at one location of the housing and a second interconnection feature at another location of the housing, wherein the first interconnection feature of the connector is configured to complement and engage with a second interconnection feature of the identical connector, the housing including opposed walls that define a recessed channel therein having depth defined between a channel floor and a channel opening, the housing comprising a first section that extends from a first end of the housing a length to a housing second section that extends a length to a housing second end, wherein the opposed walls include a first pair of opposed walls that extends along the housing first section and a second pair of opposed walls that extends along the housing second section, wherein the first pair of opposed walls are spaced apart a different distance than the second pair of opposed walls; and a plurality of electrical terminals disposed within the recessed channel and extending a length from the floor towards the channel opening, wherein each electrical terminal includes a contact section disposed in the channel that is configured to provide a point of mechanical and electrical contact between the connector and the identical connector.

2. The connector as recited in claim 1, wherein each electrical terminal contact section comprises a planar section extending from the floor into the channel and an angled section extending from the planar section and forming an end of the electrical terminal, wherein the angled sections of the connector electrical terminals are configured to connect with planar sections of the identical connector electrical terminals to provide two points of mechanical and electrical contact between interconnected electrical terminals.

3. The connector as recited in claim 1, wherein the first and second walls disposed along common sides of the housing are separate from one another.

4. The connector as recited in claim 1, wherein the first pair of opposed walls are positioned a greater distance apart from one another than the second pair of opposed walls.

5. The connector as recited in claim 1, further comprising a first pair of shields disposed along an inside surface of the first pair of opposed walls, and a second pair of shields disposed along an outside surface of the second pair of opposed walls.

6. The connector as recited in claim 1, wherein the plurality of electrical terminals are interposed within the recessed channel between the first and second interconnection features.

7. The connector as recited in claim 1, wherein the housing has a generally rectangular configuration and the first and second interconnection features are located adjacent opposed longitudinal first and second ends of the housing.

8. The connector as recited in claim 1, wherein the first interconnection feature is positioned at one end of the housing within a portion of the channel, wherein the second interconnection feature is positioned at end of the housing opposite the first interconnection feature, wherein the second interconnection feature is positioned outside of the channel, and wherein the first interconnection feature includes a member extending outwardly from the channel floor and the second interconnection feature includes a cavity.

9. The connector as recited in claim 1, wherein the electrical terminals are oriented within the channel in one or more rows, and wherein the floor adjacent each electrical terminal includes a raised section that extends outwardly a distance from the floor along a partial section of the electrical terminal to thereby isolate such partial section from a partial section of an adjacent electrical terminal in the same row.

10. The connector as recited in claim 1, wherein each electrical terminal contact section comprises a planar section adjacent the floor that extends axially and forms a pair of angled sections extending therefrom, wherein the angled sections of the connector electrical terminals are configured to connect with planar sections of the identical connector electrical terminals to provide four points of mechanical and electrical contact between interconnected electrical terminals.

11. A connector having a hermaphroditic design such that the connector is configured to mechanically attach and electrically connect with an identical electrical connector, the hermaphroditic connector comprising:

a housing comprising a recessed open channel defined by opposed walls and a floor, the housing comprising a first interconnection feature at one longitudinal end of the housing and disposed within the channel and a second interconnection feature at another longitudinal end of the housing opposite the first interconnection feature and located outside of the channel, wherein the connector first and second interconnection features are configured to fit together with respective second and first interconnection features of the identical connector;

a plurality of electrical terminals disposed within the channel, wherein each electrical terminal includes a first section that extends upwardly from the channel floor and a second section that extends in an opposite direction through the floor to an underside surface for connecting with a board, wherein the electrical terminals are oriented in one or more rows and one or more columns, wherein each electrical terminal includes an angled section extending from the first section, and wherein each connector electrical terminal is configured to provide two or more points of mechanical and electrical contact with an electrical terminal of the identical connector; and one or more shield elements connected with the housing along one or more channel walls, wherein the connector one or more shield elements are configured and positioned to contact one or more shield elements of the identical connector.

12. The connector as recited in claim 11, wherein the electrical terminal first section is a planar section that extends a distance from the floor to the angled section, wherein the angled section has a V-shape relative to a plane running along the planar section and that includes an end section that is aligned with the plane of the planar section, wherein when the electrical terminal end section is configured to make two points of mechanical and electrical contact with a planar section of an electrical terminal of the identical connector.

13. The connector as recited in claim 12, wherein the electrical terminal planar section has a width that is greater than that of the electrical terminal end section.

14. The connector as recited in claim 12, wherein each electrical terminal end section includes an angled portion having a positive angle of departure relative to the plane running along the planar section to facilitate engagement and interconnection with an electrical terminal of the identical connector.

15. The connector as recited in claim 12, wherein the channel comprises a first section that extends longitudinally a distance and that has a width defined by a pair of opposed walls, and a second section that extends longitudinally from the first section and that has a width defined by a pair of opposed walls, and wherein the channel first section width is sized differently from the channel second section width.

16. The connector assembly as recited in claim 15, wherein the connector channel first section is configured to fit within a channel second section of the identical connector.

17. The connector as recited in claim 16, wherein the shield elements are positioned along the opposed walls of the channel first and second sections, and wherein the shield elements include segments extending through the channel floor to the channel underside surface.

18. The connector as recited in claim 11, wherein the electrical terminal first section comprises a planar section extending a distance from the floor to the angled section, wherein the connector electrical terminal angled section is split into two angled portions that are each configured to make contact with the planar section of an electrical terminal of the identical connector to provide four points of mechanical and electrical contact between interconnected electrical terminals.

19. A method for forming multiple electrical contacts between electrical terminals disposed in a pair of electrical connectors, the method comprising the steps of:

aligning a first connector with a second connector wherein the first and second connectors are duplicates of one another, wherein first and second interconnection features of each connector are oriented such that the first interconnection feature of the first connector is positioned to engage the second interconnection feature of the second connector, wherein each connector comprises a plurality of electrical terminals disposed within a channel having an open end and a floor, wherein the first and second connectors are oriented with each channel open end facing one another with the electrical terminals of each connector directed towards one another; and combining the first and second connectors together so that the first and second interconnection features of the respective connectors engage and fit together one another, wherein the electrical terminals each comprise a first section and a second section, wherein the first section of each electrical terminal of the first connector is in contact with the second section of a respective opposed electrical terminal of the second connector to provide a point of electrical contact between each opposed pair of interconnected electrical terminals, wherein each connector has first opposed sides extending along the connector a length along the channel and has second opposed sides extending along the connector a length along the channel from the first opposed sides, wherein a distance between the first opposed sides is different that a distance between the second opposed sides, and wherein during combining the first and second connector the first opposed sides of each connector nest with the second opposed sides.

20. The method as recited in claim 19 wherein during the step of combining, the channels of the first and second connectors nest with one another and two or more points of contact are made between respective shield elements that are disposed in the channels of the first and second connectors.

* * * * *